US007775569B2

(12) United States Patent
Blondeau et al.

(10) Patent No.: US 7,775,569 B2
(45) Date of Patent: Aug. 17, 2010

(54) TWEEZERS AND GRASPING SYSTEM

(75) Inventors: Fabien Blondeau, Chézard-St-Martin (CH); Mauro Lorenzini, Zuchwil (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 599 days.

(21) Appl. No.: 11/748,222

(22) Filed: May 14, 2007

(65) Prior Publication Data

US 2008/0034924 A1 Feb. 14, 2008

(30) Foreign Application Priority Data

May 12, 2006 (EP) ..... 06113848

(51) Int. Cl.
*B25B 9/02* (2006.01)

(52) U.S. Cl. ..... 294/3; 294/86.4; 294/99.2; 81/6

(58) Field of Classification Search ..... 294/1.1, 294/3, 86.4, 99.2, 902; 81/6–8; 606/210, 606/211; 271/18.1
See application file for complete search history.

(56) References Cited

U.S. PATENT DOCUMENTS 2,636,971 A * 4/1953 Delbrook ..... 219/233
3,611,842 A * 10/1971 Skipper ..... 294/99.2
3,638,516 A 2/1972 Wondowski
3,980,861 A * 9/1976 Fukunaga ..... 219/230
4,076,028 A * 2/1978 Simmons ..... 606/51
4,213,460 A * 7/1980 Weiner ..... 606/131
5,250,046 A * 10/1993 Lee ..... 606/29
6,648,389 B2 * 11/2003 Frey et al. ..... 294/86.4

FOREIGN PATENT DOCUMENTS

CH 667839 A5 11/1988
DE 2206718 8/1973
JP 2000-326242 11/2000

OTHER PUBLICATIONS

European Search Report issued in corresponding application No. EP 06 11 3848, completed Feb. 22, 2007.

* cited by examiner

*Primary Examiner*—Dean J Kramer
(74) *Attorney, Agent, or Firm*—Griffin & Szipl, P.C.

(57) ABSTRACT

The invention proposes tweezers (12) and a grasping system (10) for grasping and assembling at least one component (14) in a timepiece, comprising first and second branches (16, 18), which are joined at a first end (20) of the tweezers (12) and which form a grasping pincer (22) at the second end of the tweezers (12) in order to allow the component (14) to be grasped by the pincer (22), via a manual manipulation of the tweezers (12), characterized in that the first branch (16) includes at least one electrostatic grasping surface (24) provided for grasping, via electrostatic attraction, a component (14) made of conductive or semiconductor material.

33 Claims, 2 Drawing Sheets

TWEEZERS AND GRASPING SYSTEM

This application claims priority from European Patent Application No. 06113848.3, filed May 12, 2006, the entire disclosure of which is incorporated herein by reference.

FIELD OF THE INVENTION

The invention concerns tweezers and a system for grasping and assembling components in a timepiece.

The invention more specifically concerns tweezers for grasping and assembling at least one component in a timepiece, comprising first and second branches which are joined at a first end of the tweezers and which form a grasping pincer at the second end of the tweezers for the purpose of grasping the component via the pincer, by a manual manipulation of the tweezers.

BACKGROUND OF THE INVENTION

During assembly of timepiece components of small dimensions, such as display hands, watchmakers usually use tweezers, which enables them to manipulate the components and position them more precisely in order to create an assembly in a timepiece. Such tweezers are disclosed and shown, for example, in U.S. Pat. No. 3,638,516.

It has become clear that, for certain types of components, the tweezers tend to leave marks on the components. In particular, when the components are made of a semiconductor material such as silicon, the very fragile external surface is marked by scratches from handling by the tweezers, which is damaging to the final aesthetic appearance of the timepiece. Handling by tweezers can even cause breakage of the component.

Grasping the timepiece components by suction has already been proposed, particularly in CH Patent No. 667 839. However, this solution does not solve the problem of marking or breakage of fragile components.

It is an object of the present invention to overcome this problem by proposing a tool which allows easy and precise handling without altering the surface of the components being handled.

SUMMARY OF THE INVENTION

Thus, the invention proposes tweezers of the type previously described, characterized in that the first branch comprises at least one electrostatic grasping surface provided for grasping a component made of conductive or semiconductor material by electrostatic attraction.

The tweezers according to the invention have the advantage of being particularly easy to hold in the hand since they have the shape of a tool that is used daily by watchmakers. Moreover, they can be used in a conventional mode, by means of the pincer, and in an advanced mode, by means of the electrostatic grasping surface, which enables them to be adapted to the requirements of watchmakers.

Preferably, the electrostatic grasping surface is arranged on the side of the outer face of the branch, which facilitates the holding of components by making the electrostatic grasping surface easily accessible while allowing the user to continue to use the conventional pincer for grasping less fragile conventional components.

According to one advantageous embodiment, the electrostatic grasping surface has at least one guide portion, which is provided to force the component to occupy a determined position on the electrostatic grasping surface. This feature enables the component to obtain a stable relative position on the grasping surface, thereby facilitating assembly operations. Moreover, since the tweezers are used for assembling a watch hand on an arbour, the electrostatic grasping surface comprises at least one orifice provided for the passage of the arbour when the hand is positioned thereon, which facilitates the mounting of the hand on its drive arbour in the timepiece.

Advantageously, at least one part of the electrostatic grasping surface belongs to an added element, which is removably secured to the first branch by snap fit. Interchangeable electrostatic grasping surfaces can thus be used as a function of the components to be handled.

According to other features of the invention, the branches are made of an electrically conductive material and the electrostatic grasping surface is made of a synthetic electrically insulating material, whose hardness and surface appearance are provided so as not to alter the surface appearance of the component being grasped.

The first branch comprises an electrode supplied with an electric current by a powering device and an insulating envelope made of dielectric material, which covers the electrode, and the insulating envelope comprises an outer surface that forms the electrostatic grasping surface.

The powering device can be carried by the tweezers or offset in relation to the tweezers.

Preferably, a member controlling the intensity of the electrostatic attractive force produced on the electrostatic grasping surface is arranged on the tweezers, which enables the attraction force to be adapted to the component to be handled, and which allows the component to be released when desired.

The present invention also proposes an electrostatic grasping system comprising tweezers as previously described and including a member, off-set relative to the tweezers, which controls the intensity of the electrostatic attractive force produced on the electrostatic grasping surface. The control member is a pedal, which varies the intensity of the electrostatic attractive force as a function of the pressing force applied to the pedal.

These features enable the grasping system according to the invention to be particularly ergonomic since the user has both hands free for handling the components using the tweezers and for holding the timepiece, while his feet control the electrostatic attractive force.

BRIEF DESCRIPTION OF THE DRAWINGS

Other features and advantages of the present invention will appear more clearly upon reading the following detailed description, made with reference to the annexed drawings, given by way of non-limiting example and in which.

DETAILED DESCRIPTION OF THE ILLUSTRATIVE EMBODIMENTS

In the following description, identical or similar elements bear the same references.

Figure 1:
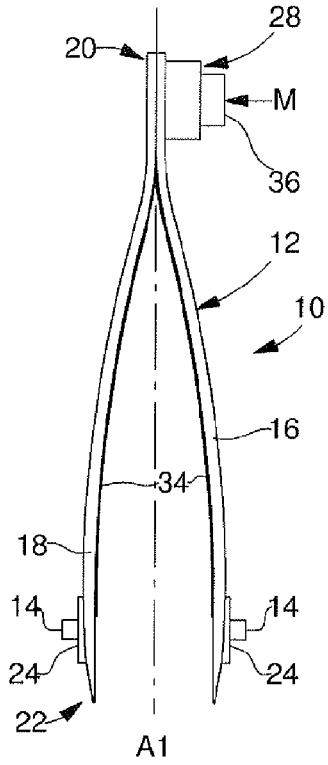
FIG. 1 is a side view that shows schematically a grasping system comprising tweezers made in accordance with the teaching of the invention according to a first embodiment.

FIG. 1 shows a grasping system 10 according to a first embodiment comprising tweezers 12 for grasping and assembling at least one component 14 in a timepiece (not shown), particularly in a wristwatch.

The component 14 to be grasped is formed, for example, of a display hand 15, which has to be fitted onto an arbour of the timepiece. Of course, other components 14 can be handled by means of grasping system 10 according to the invention, particularly arbours, wheels, springs . . . .

In the following description, a vertical axial orientation along the general axis A1 of tweezers 12 will be used in a non-limiting manner.

Tweezers 12 comprise first and second branches 16, 18 which are joined at a first axial end 20 of the tweezers and which form a grasping pincer 22 at the second axial end of the tweezers in order to allow component 14 to be grasped by pincer 22, by a manual manipulation of tweezers 12.

Branches 16, 18 are made of an electrically conductive material and they are placed at a determined potential, for example earth.

In accordance with the teaching of the invention, the first branch 16 comprises at least one electrostatic grasping surface 24 provided for grasping, by electrostatic attraction, a component 14 made of a conductive or semiconductor material, particularly hands 15 made of silicon-based crystalline material. Prior to being grasped, component 14 is placed on a support (not shown) made of electrically conductive material, placed at a determined potential corresponding to the potential of branches 16, 18, for example earth.

According to the embodiment shown, the electrostatic grasping surface 24 is formed by the outer surface of an insulating envelope 30 which covers electrode 26. Electrode 26 is supplied with electric current by a powering device 28.

Insulating envelope 30 is made of a dielectric material and it entirely covers electrode 26. Insulating envelope 30 has a parallelepiped shape here. In order to guarantee a sufficient electrostatic attractive force with a reasonable voltage, the thickness of insulating envelope 30, between electrode 26 and electrostatic grasping surface 24, must be relatively small.

Advantageously, electrode 26 and insulating envelope 30 are arranged on the outer face 32 of the first branch 16, such that electrostatic grasping surface 24 is orientated on the side opposite axis A1. Insulating envelope 30 is made of a synthetic material whose surface appearance is provided to allow a non-aggressive contact between component 14 and grasping surface 24, so as not to alter the surface appearance of component 14.

According to the embodiment shown here, powering device 28 is carried by the first end 20 of tweezers 12 and it is electrically connected to electrode 26 by a wire 34. Powering device 28 includes, for example, a rechargeable battery and a high voltage generator (from 0.01 to 10 kV).

Figure 2:
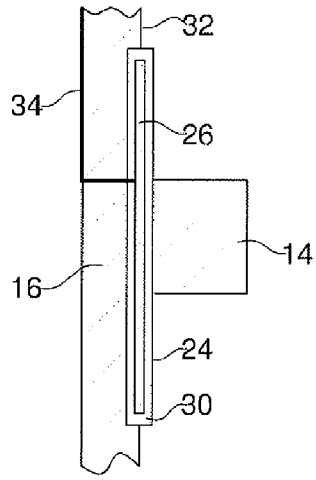
FIG. 2 is an axial cross-section of a portion of a branch of the tweezers of FIG. 1 for the electrostatic grasping of a component.

Powering device 28 comprises a control member 36, which allows the user of tweezers 12 to manually control M the powering of electrode 26 to cause the electrostatic attraction of component 14 and thus to hold it pressed against electrostatic grasping surface 24, as shown in FIGS. 1 and 2.

It will be noted that the intensity of the electrostatic attractive force for holding component 14 pressed against electrostatic grasping surface 24 is relatively low because of the low weight of a component 14, such as a display hand 15. Consequently, during certain assembly operations of component 14, for example during assembly of hand 15 on an arbour, if it is held in position on the arbour by a mechanical force such as a gripping force, it is not indispensable to implement any particular control strategy of powering device 18 in order to release component 14.

Control member 36 can be formed by a switch and, preferably, when the user stops powering electrode 26, an electric power control strategy is implemented in order to release component 14, for example by causing several alternating pulses of decreasing amplitude.

The operation of tweezers 12 according to the first embodiment of the invention is set out below.

When the user, generally a watchmaker, is handling and assembling components 14 which are not particularly fragile, for example components 14 made of brass, then he uses the conventional pincer 22 for grasping the component 14 and positioning it in the timepiece, simply by exerting mechanical pressure with his fingers on branches 16, 18 of tweezers 12.

When the user is handling and assembling components 14 that must be subjected to particular precautions to avoid damaging or scratching the same, for example silicon hands 15, then he controls the powering of electrode 26 by means of switch 36, which charges the insulating envelope 30 by producing, on electrostatic grasping surface 24, an attraction force which enables component 14 to be grasped without needing to exert any mechanical pressure thereon. The user can then move component 14 in the timepiece in order to position it, then release component 14 by again acting on switch 36.

It should be noted that since the component 14 made of conductive or semiconductor material is placed on a support at the same potential as branches 16, 18, which here is earth, then component 14 is itself at earth. When electrostatic grasping surface 24 approaches component 14, the powering of electrode 26 causes a difference in potential between electrode 26 and component 14, which generates an electric field and an electrostatic attractive force. Electric charges appear on electrostatic grasping surface 24 and on component 14. When the electrostatic force is sufficient, component 14 will be pressed against electrostatic grasping surface 24. Since the majority of the electric charges mobilised in component 14 remain on component 14, the electrostatic attractive force is maintained which enables component 14 to be moved while keeping it pressed against electrostatic grasping surface 24, until it is released by action on switch 36.

Figure 3:
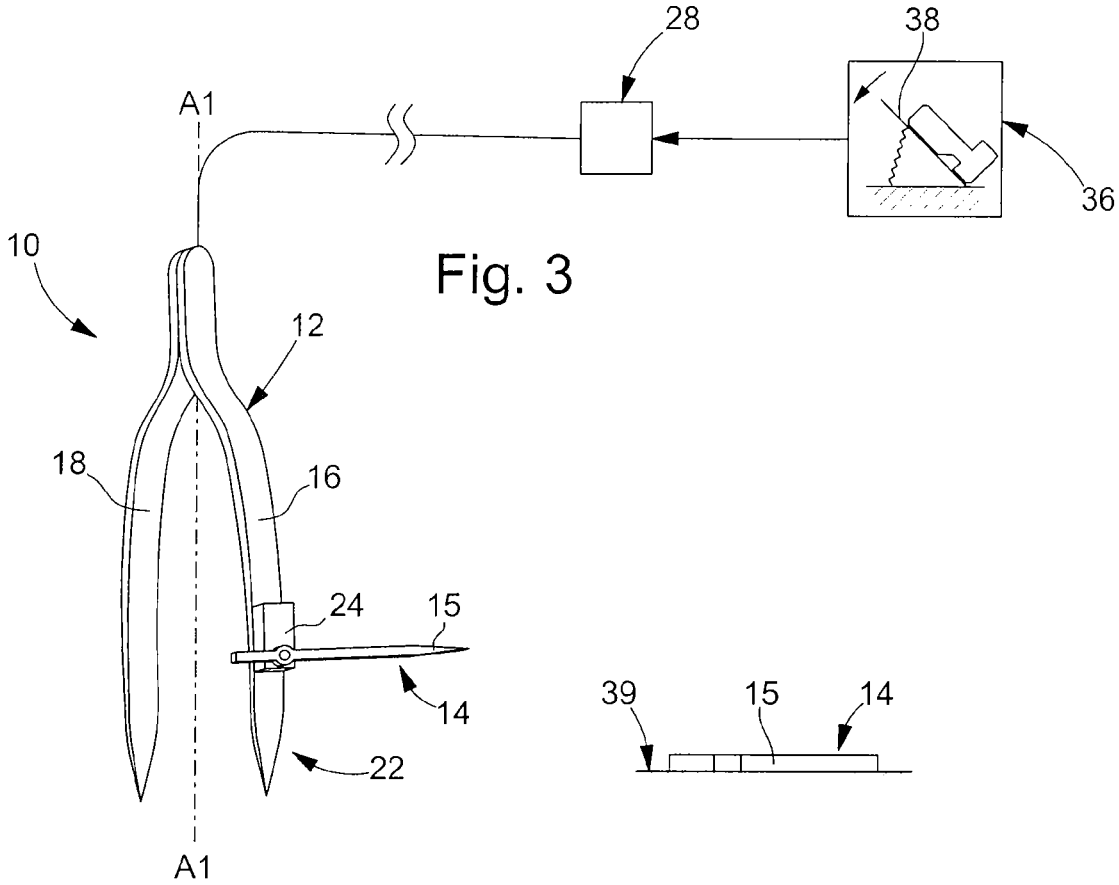
FIG. 3 is a perspective view that shows a second embodiment of the grasping system of FIG. 1 comprising a powering device that is offset and controlled by a pedal.
Figure 4:
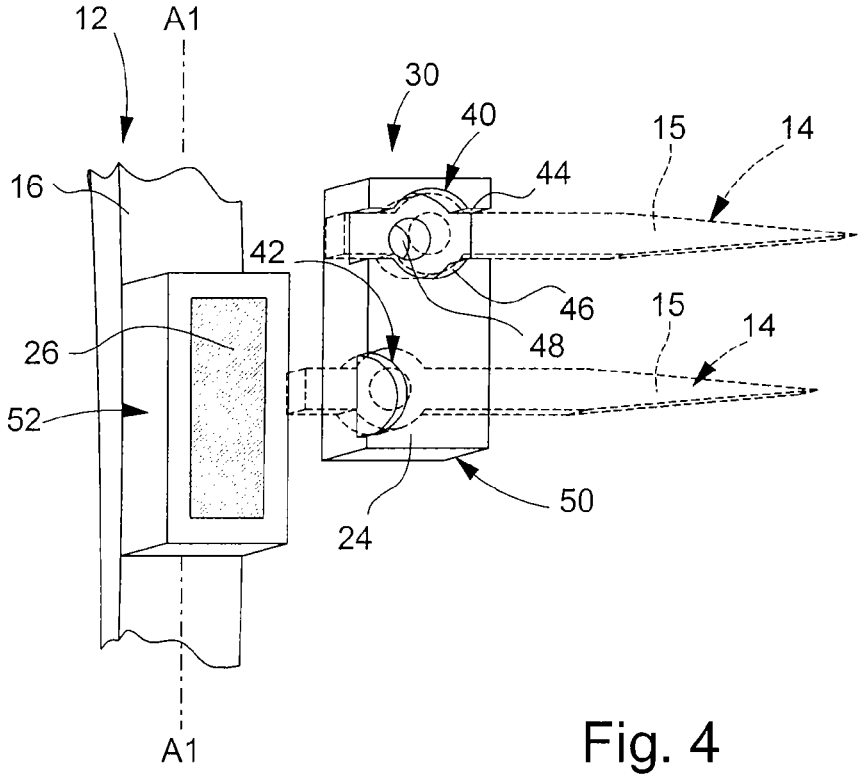
FIG. 4 is a perspective view that shows an advantageous embodiment of the grasping surface of the tweezers of FIG. 3.

The second embodiment, which is shown in FIGS. 3 and 4, will now be described, with particular reference to the technical features that differentiate this second embodiment from the first embodiment.

According to the second embodiment, powering device 28 is offset relative to tweezers 12, the electrical connection wire 34 extending from tweezers 12 to powering device 28. Moreover, control member 36 is formed by a pedal 38, which enables the user to vary the intensity of the electrostatic attractive force, on electrostatic grasping surface 24, as a function of the force that he exerts on pedal 28 with his foot.

FIG. 3 shows a support 39, on which component 14 is placed prior to being grasped. As mentioned previously, support 39 is placed at the same electric potential as branches 16, 18 of tweezers 12, here it is placed at earth.

In the second embodiment, electrostatic grasping surface 24 has at least one guide portion 40, 42 provided for forcing component 14 to occupy a determined position on electrostatic grasping surface 24.

FIG. 4 shows first and second guide portions 40, 42, which are arranged on electrostatic grasping surface 24 in order to form complementary housings for hands 15 shown in dotted lines.

According to the example shown, the first guide portion 40 extends over the entire width of grasping surface 24 and it has the shape of an end section of hand 15 located on the side of the axis of rotation thereof. The first guide portion 40 is formed here by a recess delimited by two opposite edges 44, 46, which force hand 15 to be orientated along a transverse direction relative to axis A1, as shown in FIG. 3. Thus, hand 15 is not only held on electrostatic grasping surface 24 by the electrostatic attractive force, but it is also held in a determined position relative to electrostatic grasping surface 24 which then facilitates the positioning of hand 15 by the user in the timepiece for the assembly thereof.

According to the example shown, the second guide portion 42 is a housing that has the shape of a half-disc but it could take any other shape adapted to the shape of the component 14 to be handled.

According to an improvement of this second embodiment, the first guide portion 40 includes, opposite the arbour hole for hand 15, an orifice 48 for receiving the axial end section of the arbour on which hand 15 will be mounted. Thus, when the user positions hand 15 in order to mount it on the arbour, he can exert pressure on hand 15 with tweezers 12 without directly abutting the end of the arbour.

Guide portions 40, 42 are formed here by hollows shapes, but they could also be made in the form of ribs delimiting complementary housings for portions of the component 14 to be handled.

Of course, guide portions 40, 42 can also be arranged on grasping surface 24 of the first embodiment.

Advantageously, at least one part of the electrostatic grasping surface 24 belongs to an added element 50, which is removably secured to first branch 16. According to the example embodiment shown, the added element 50 is formed by a plate of dielectric material, which is snap fitted to a plate 52 of dielectric material. Plate 52 is secured to the first branch 16 of tweezers 12, for example by bonding, and it comprises a housing that receives electrode 26. The added element 50 and plate 42 together form insulating envelope 30 which encloses electrode 26.

The advantage of the added element 50 is that it facilitates the changing of electrostatic grasping surface 24 and thus allows the use of an electrostatic grasping surface 24 whose raised portions 40, 42 are adapted to the component 14 to be grasped. Thus, if one wishes to handle silicon wheels, one only has to replace the added element 50 for hands 15 by an added element 50 fitted with portions 40, 42 that complement the wheel to be grasped.

According to a variant (not shown), insulating envelope 30 can be entirely secured in a removable manner to tweezers 12, which, if necessary, enables tweezers 12 to be used without the electrostatic grasping surface 24.

The operation of the grasping system according to the invention will now be described with reference to the second embodiment.

In order to grasp a silicon hand 15, the user moves electrostatic grasping surface 24 close to the support carrying hand 15, approximately aligning hand 15 with the first guide portion 40. Simultaneously, the user presses on pedal 38 to power electrode 26 and gradually increase the electrostatic attractive force until hand 15 is pressed against electrostatic grasping surface 24. Due to the attraction force and due to the appropriate shape of the first guide portion 40, hand 15 positions itself in a suitable manner in the first guide portion 40, such that the arbour hole thereof faces orifice 48.

The user then carries hand 15 with tweezers 12 to the timepiece in which it has to be assembled. The user then fits hand 15 onto the corresponding arbour of the timepiece by threading hand 15 onto the arbour until the free end of the arbour is accommodated in orifice 18 of electrostatic grasping surface 24.

When hand 15 is fitted, the user raises the pedal 38 which cancels the electrostatic attractive force and releases hand 15, the latter being in any event held on the arbour via its fit, similar to driving in.

The invention has been described with reference to tweezers 12 that comprise an electrostatic grasping surface 24 solely on the first branch 6. Of course, the second branch 18 of tweezers 12 could also include an electrostatic grasping surface 24 similar to that previously described. It could comprise guide portions 40, 42, different from those of the first branch 16, which would increase the number of components able to be grasped by electrostatic attraction using the same tweezers 12.

What is claimed is:

1. A tweezers for grasping and assembling at least one component in a timepiece, the tweezers including first and second branches which are joined at a first end of the tweezers and which form a grasping pincer at a second end of the tweezers, in order to enable the component to be grasped by the pincer, via a manual manipulation of the tweezers, the user exerting a mechanical pressure with his fingers on the branches of the tweezers, wherein the first branch includes at least one electrostatic grasping surface, the at least one electrostatic grasping surface having sufficient electrostatic grasping force to hold a component made of semiconductor material on the at least one electrostatic grasping surface, and wherein the at least one electrostatic grasping surface is arranged on an outer face of the first branch.

2. The tweezers according to claim 1, wherein at least one part of the electrostatic grasping surface belongs to an added element which is removably secured to the first branch.

3. The tweezers according to claim 1, wherein the branches are made of an electrically conductive material.

4. The tweezers according to claim 1, wherein the electrostatic grasping surface is made of an electrically insulating material so as not to alter the surface appearance of the component to be grasped.

5. The tweezers according to claim 1, wherein the first branch includes an electrode supplied with electric current by a powering device and an insulating envelope made of dielectric material which covers the electrode, and wherein the insulating envelope includes an outer surface that forms the electrostatic grasping surface.

6. The tweezers according to claim 5, wherein the powering device is carried by the tweezers.

7. The tweezers according to claim 5, wherein the electrode is connected to a powering device that is offset relative to the tweezers.

8. The tweezers according to claim 5, wherein a member controlling the intensity of the electrostatic attractive force produced on the electrostatic grasping surface is arranged on the tweezers.

9. The tweezers according to claim 1, wherein the second branch also includes an electrostatic grasping surface.

10. A tweezers for grasping and assembling at least one component in a timepiece, the tweezers including first and second branches which are joined at a first end of the tweezers and which form a grasping pincer at a second end of the tweezers, in order to enable the component to be grasped by the pincer, via a manual manipulation of the tweezers, the user exerting a mechanical pressure with his fingers on the branches of the tweezers, wherein the first branch includes at least one electrostatic grasping surface, the at least one electrostatic grasping surface having sufficient electrostatic grasping force to hold a component made of electrically conductive material on the at least one electrostatic grasping surface, wherein the at least one electrostatic grasping surface is made of a synthetic insulating material, and wherein the at least one electrostatic grasping surface is arranged on an outer face of the first branch.

11. The tweezers according to claim 10, wherein the branches are made of an electrically conductive material.

12. The tweezers according to claim 10, wherein the electrostatic grasping surface is made of an electrically insulating material so as not to alter the surface appearance of the component to be grasped.

13. The tweezers according to claim 10, wherein the first branch includes an electrode supplied with electric current by a powering device and an insulating envelope made of dielectric material which covers the electrode, and wherein the insulating envelope includes an outer surface that forms the electrostatic grasping surface.

14. The tweezers according to claim 10, wherein the second branch also includes an electrostatic grasping surface.

15. An electrostatic grasping system including tweezers for grasping and assembling at least one component in a timepiece, the tweezers including first and second branches which are joined at a first end of the tweezers and which form a grasping pincer at a second end of the tweezers, in order to enable the component to be grasped by the pincer, via a manual manipulation of the tweezers, the user exerting a mechanical pressure with his fingers on the branches of the tweezers, wherein the first branch includes at least one electrostatic grasping surface, the at least one electrostatic grasping surface having sufficient electrostatic grasping force to hold a component made of semiconductor material on the at least one electrostatic grasping surface, wherein the first branch includes an electrode supplied with electric current by a powering device and an insulating envelope made of dielectric material which covers the electrode, and wherein the insulating envelope is arranged on an outer face of the first branch and the at least one electrostatic grasping surface is formed on an outer surface of the insulating envelope, and the electrostatic grasping system further including a member, offset relative to the tweezers, which controls the intensity of the electrostatic attractive force produced on the at least one electrostatic grasping surface.

16. The electrostatic grasping system according to claim 15, wherein the powering device is carried by the tweezers.

17. The electrostatic grasping system according to claim 16, wherein the electrode is connected to a powering device that is offset relative to the tweezers.

18. The electrostatic grasping system according to claim 15, wherein the electrode is connected to a powering device that is offset relative to the tweezers.

19. The electrostatic grasping system according to claim 15, wherein the second branch of the tweezers also includes an electrostatic grasping surface.

20. An electrostatic grasping system including tweezers for grasping and assembling at least one component in a timepiece, the tweezers including first and second branches which are joined at a first end of the tweezers and which form a grasping pincer at a second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface, the at least one electrostatic grasping surface having sufficient electrostatic grasping force to hold a component made of electrically conductive material on the at least one electrostatic grasping surface, wherein the at least one electrostatic grasping surface is made of a synthetic insulating material, wherein the first branch includes an electrode supplied with electric current by a powering device and an insulating envelope made of dielectric material which covers the electrode, and wherein the insulating envelope is arranged on an outer face of the first branch and the at least one electrostatic grasping surface is formed on an outer surface of the insulating envelope.

21. The electrostatic grasping system according to claim 20, wherein the powering device is carried by the tweezers.

22. The electrostatic grasping system according to claim 21, wherein the electrode is connected to a powering device that is offset relative to the tweezers.

23. The electrostatic grasping system according to claim 20, wherein the electrode is connected to a powering device that is offset relative to the tweezers.

24. The electrostatic grasping system according to claim 20, wherein the second branch of the tweezers also includes an electrostatic grasping surface.

25. A tweezers for grasping and assembling at least one component in a timepiece, including first and second branches which are joined at a first end of the tweezers and which form a grasping pincer at the second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface provided for grasping, via electrostatic attraction, a component made of semiconductor material, and wherein the electrostatic grasping surface has at least one guide portion which is provided for forcing the component to occupy a determined position on the electrostatic grasping surface.

26. A tweezers for grasping and assembling at least one component in a timepiece, including first and second branches which are joined at a first end of the tweezers and which form a grasping pincer at the second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface provided for grasping, via electrostatic attraction, a component made of semiconductor material, wherein the tweezers are used for assembling a watch hand on an arbour, and wherein the electrostatic grasping surface includes at least one orifice provided for the passage of the arbour when the hand is being positioned on the arbour.

27. A tweezers for grasping and assembling at least one component in a timepiece, including first and second branches which are joined at a first end of the tweezers and which form a grasping pincer at the second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface provided for grasping, via electrostatic attraction, a component made of semiconductor material, wherein at least one part of the electrostatic grasping surface belongs to an added element which is removably secured to the first branch, and wherein the added element is secured to the first branch by snap fit.

28. An electrostatic grasping system, including tweezers for grasping and assembling at least one component in a timepiece, including first and second branches which are joined at a first end of the tweezers and which form a grasping pincer at the second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface provided for grasping, via electrostatic attraction, a component made of semiconductor material, wherein the first branch includes an electrode supplied with electric current by a powering device and an insulating envelope made of dielectric material which covers the electrode, wherein the insulating envelope includes an outer surface that forms the electrostatic grasping surface, and further including a member, offset relative to the tweezers, which controls the intensity of the electrostatic attractive force produced on the electrostatic grasping surface, and wherein the powering device comprises a control member pedal, which varies the electrostatic attractive force as a function of the pressing force applied to the pedal.

29. The electrostatic grasping system according to claim 28, wherein the second branch of the tweezers also includes an electrostatic grasping surface.

30. An electrostatic grasping system including tweezers for grasping and assembling at least one component in a timepiece, including first and second branches which are joined at a first end of the tweezers and which form a grasping pincer at the second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface provided for grasping, via electrostatic attraction, a component made of electrically conductive material, wherein the electrostatic grasping surface is made of a synthetic insulating material, wherein the first branch includes an electrode supplied with electric current by a powering device and an insulating envelope made of dielectric material which covers the electrode, wherein the insulating envelope includes an outer surface that forms the electrostatic grasping surface, and wherein the powering device comprises a control member pedal, which varies the electrostatic attractive force as a function of the pressing force applied to the pedal.

31. The electrostatic grasping system according to claim 30, wherein the second branch of the tweezers also includes an electrostatic grasping surface.

32. A tweezers for grasping and assembling at least one component in a timepiece, including first and second branches which are joined at a first end of the tweezers and which form a grasping pincer at the second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface provided for grasping, via electrostatic attraction, a component made of electrically conductive material, wherein the electrostatic grasping surface is made of a synthetic insulating material, and wherein the electrostatic grasping surface has at least one guide portion which is provided for forcing the component to occupy a determined position on the electrostatic grasping surface.

33. A tweezers for grasping and assembling at least one component in a timepiece, including first and second branches which are joined at a first end of the tweezers and which form a grasping pincer at the second end of the tweezers in order to enable the component to be grasped by the pincer, via a manual manipulation of the tweezers, the user exerting a mechanical pressure with his fingers on the branches of the tweezers, wherein the first branch includes at least one electrostatic grasping surface provided for grasping, via electrostatic attraction, a component made of electrically conductive material, wherein the electrostatic grasping surface is made of a synthetic insulating material, wherein the tweezers are used for assembling a watch hand on an arbour, and wherein the electrostatic grasping surface includes at least one orifice provided for the passage of the arbour when the hand is being positioned on the arbour.

* * * * *